US011441091B2

(12) United States Patent
Miyazaki et al.

(10) Patent No.: US 11,441,091 B2
(45) Date of Patent: Sep. 13, 2022

(54) GREASE BASE OIL AND GREASE COMPOSITION CONTAINING SAID GREASE BASE OIL

(71) Applicants: KAO CORPORATION, Tokyo (JP); KYODO YUSHI CO., LTD., Fujisawa (JP)

(72) Inventors: Tatsuya Miyazaki, Wakayama (JP); Yuta Kanazawa, Kanagawa (JP); Tomonobu Komoriya, Kanagawa (JP); Hiroyuki Ishikawa, Kanagawa (JP); Yuta Sato, Kanagawa (JP)

(73) Assignees: KYODO YUSHI CO., LTD., Fujisawa (JP); KAO CORPORATION, Tokyo (JP)

( * ) Notice: Subject to any disclaimer, the term of this patent is extended or adjusted under 35 U.S.C. 154(b) by 0 days.

(21) Appl. No.: 17/312,666

(22) PCT Filed: Jan. 30, 2020

(86) PCT No.: PCT/JP2020/003370

§ 371 (c)(1),
(2) Date: Jun. 10, 2021

(87) PCT Pub. No.: WO2020/166354

PCT Pub. Date: Aug. 20, 2020

(65) Prior Publication Data

US 2022/0064559 A1 Mar. 3, 2022

(30) Foreign Application Priority Data

Feb. 12, 2019 (JP) ..... JP2019-022657

(51) Int. Cl.

| | |
|---|---|
| ***C10M 105/34*** | (2006.01) |
| ***C10M 105/38*** | (2006.01) |
| *C10N 20/02* | (2006.01) |
| *C10N 30/02* | (2006.01) |
| *C10N 30/08* | (2006.01) |
| *C10N 40/02* | (2006.01) |
| *C10N 50/10* | (2006.01) |

(52) U.S. Cl.

CPC ..... *C10M 105/34* (2013.01); *C10M 105/38* (2013.01); *C10M 2207/283* (2013.01); *C10M 2207/2805* (2013.01); *C10M 2207/2815* (2013.01); *C10M 2207/2845* (2013.01); *C10N 2020/02* (2013.01); *C10N 2030/02* (2013.01); *C10N 2030/08* (2013.01); *C10N 2040/02* (2013.01); *C10N 2050/10* (2013.01)

(58) Field of Classification Search

CPC ..... C10M 105/34; C10M 105/38; C10M 2207/2805; C10M 2207/2815; C10M 2207/283; C10M 2207/2845; C10N 2030/02; C10N 2030/10; C10N 2050/10; C10N 2040/02; C10N 2020/02

See application file for complete search history.

(56) References Cited

U.S. PATENT DOCUMENTS

| | | | | |
|---|---|---|---|---|
| 3,562,300 | A * | 2/1971 | Chao et al. | C07C 69/22 554/165 |
| 4,212,816 | A | 7/1980 | Hentschel et al. | |
| 4,362,635 | A | 12/1982 | Dhein et al. | |
| 5,057,247 | A * | 10/1991 | Schmid | C10M 105/38 508/481 |
| 8,772,530 | B2 * | 7/2014 | Inayama | C07C 69/33 560/190 |
| 2013/0207024 | A1 | 8/2013 | Takigawa et al. | |
| 2018/0057764 | A1 | 3/2018 | Bae et al. | |
| 2020/0063057 | A1 * | 2/2020 | Miyazaki | C10M 105/40 |
| 2020/0080016 | A1 | 3/2020 | Miyazaki | |

FOREIGN PATENT DOCUMENTS

| | | | |
|---|---|---|---|
| CN | 102959065 | A | 3/2013 |
| CN | 103865606 | A | 6/2014 |
| DE | 27 58 780 | A1 | 7/1979 |
| JP | 54-96667 | A | 7/1979 |
| JP | 55-58297 | A | 4/1980 |
| JP | 2018-95840 | A | 6/2018 |
| JP | 2018-100369 | A | 6/2018 |

OTHER PUBLICATIONS

International Preliminary Report on Patentability and Written Opinion of the International Searching Authority for International Application No. PCT/JP2020/003370, dated Aug. 26, 2021.

International Search Report, issued in PCT/JP2020/003370, dated Apr. 7, 2020.

English translation of Chinese Search Report for Chinese Application No. 202080009624.3, dated Mar. 23, 2022.

* cited by examiner

*Primary Examiner* — Cephia D Toomer

(74) *Attorney, Agent, or Firm* — Birch, Stewart, Kolasch & Birch, LLP

(57) ABSTRACT

A grease base oil, containing: condensation esters of alcohols (A) and carboxylic acids (B), wherein the alcohols (A) include a polyhydric alcohol represented by General Formula (1), the carboxylic acids (B) include a fatty acid having 5 to 9 carbon atoms (B-1), a branched fatty acid having 15 to 20 carbon atoms (B-2), a cycloalkane monocarboxylic acid having 4 to 8 carbon atoms (B-3), and an aromatic carboxylic acid (B-4), and the carboxylic acids (B) have a percentage of (B-1) above of 30 mol % to 50 mol %, a percentage of (B-2) above of 30 mol % to 50 mol %, a percentage of (B-3) above of 10 mol % to 30 mol %, and a percentage of (B-4) above of 1 mol % to 15 mol %. The grease base oil contains condensation esters having heat resistance and low temperature storageability.

6 Claims, No Drawings

GREASE BASE OIL AND GREASE COMPOSITION CONTAINING SAID GREASE BASE OIL

TECHNICAL FIELD

The present invention relates to a grease base oil and a grease composition containing said grease base oil.

BACKGROUND ART

Lubricants are used in various fields that require friction reduction. Though traditionally, natural oils and fats and refined petroleum products have been used, in recent years, synthetic lubricants have been synthesized and used according to the purpose. In particular, synthetic esters are excellent in thermal stability, and specific examples thereof include organic acid esters, phosphoric esters, and silicic acid esters.

Among organic acid esters, from the viewpoints of 1) low pour point, high viscosity index, and wide operating temperature range, 2) high flash point, low evaporation, 3) excellent thermal and oxidative stability, 4) good lubricity, 5) detergent dispersant action, and 6) biodegradability, polyol esters (condensation esters of polyhydric alcohols and carboxylic acids) are used, and in particular, hindered esters are used in many fields because of their excellent thermal and oxidative stability.

However, in recent years, with the development of industrial technology, high productivity and operational stability are always required, and more durable and highly heat-resistant lubricants are required.

For example, Patent Document 1 discloses that a lubricant base oil containing a condensation ester of a polyhydric alcohol having a hydrogen atom, a methyl group, or a hydroxyl group and having 2 to 4 hydroxyl groups (A) and a cycloalkane monocarboxylic acid having 4 or more and 8 or less carbon atoms (B) has excellent heat resistance.

Patent Document 2 discloses that a lubricant base oil containing ester compounds of pentaerythritol, in which at least one group is a carboxylic residue and the others are selected from a hydrogen group, a methyl group, a benzoyloxy group, and a naphthoyloxy group, wherein the percentage of ester compounds in which the others are a benzoyloxy group or a naphthoyloxy group is 5 to 100 mol %, has excellent heat resistance.

PRIOR ART DOCUMENTS

Patent Documents

Patent Document 1: JP-A-2018-95840
Patent Document 2: JP-A-2018-100369

SUMMARY OF THE INVENTION

Problems to be Solved by the Invention

In particular, lubricant base oils such as grease base oils are required to maintain fluidity even after long-term storage in cold regions (have low temperature storageability).

However, the lubricant base oils specifically disclosed in Patent Documents 1 and 2 above do not have sufficient low temperature storageability.

The present invention has been made in view of the above-mentioned circumstances, and an object of the present invention is to provide a grease base oil having heat resistance and low temperature storageability and containing condensation esters, and a grease composition containing said grease base oil.

Means for Solving the Problems

That is, the present invention relates to a grease base oil, containing:

condensation esters of alcohols (A) and carboxylic acids (B), wherein the alcohols (A) include a polyhydric alcohol represented by General Formula (1):

[Formula 1]

(1)

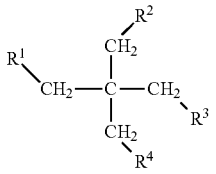

wherein $R^1$ to $R^4$ independently represent a hydrogen atom, a methyl group, or a hydroxyl group, and at least two of $R^1$ to $R^4$ represent a hydroxyl group, the carboxylic acids (B) include a fatty acid having 5 or more and 9 or less carbon atoms (B-1), a branched fatty acid having 15 or more and 20 or less carbon atoms (B-2), a cycloalkane monocarboxylic acid having 4 or more and 8 or less carbon atoms (B-3), and an aromatic carboxylic acid (B-4), and the carboxylic acids (B) have a percentage of the fatty acid (B-1) of 30 mol % or more and 50 mol % or less, a percentage of the branched fatty acid (B-2) of 30 mol % or more and 50 mol % or less, a percentage of the cycloalkane monocarboxylic acid (B-3) of 10 mol % or more and 30 mol % or less, and a percentage of the aromatic carboxylic acid (B-4) of 1 mol % or more and 15 mol % or less.

The present invention also relates to a grease composition containing the grease base oil.

Effect of the Invention

Though the details of the mechanism of action of the effect in the grease base oil according to the present invention are partially unknown, they are presumed as follows. However, the interpretation of the present invention does not have to be limited to this mechanism of action.

The present invention is a grease base oil containing condensation esters of alcohols including a polyhydric alcohol represented by the General Formula (1) (A) and carboxylic acids (B), and the carboxylic acids (B) include specific amounts of a fatty acid having 5 or more and 9 or less carbon atoms (B-1), a branched fatty acid having 15 or more and 20 or less carbon atoms (B-2), a cycloalkane monocarboxylic acid having 4 or more and 8 or less carbon atoms (B-3), and an aromatic carboxylic acid (B-4). It is presumed that the ester chain derived from this cycloalkane monocarboxylic acid is chemically stable due to the effect of the ring strain of the cyclo ring, is less susceptible to thermal deterioration of fragile sites due to the structure-derived rigidity, thus has high heat resistance and exists stably without thermal deterioration even at high temperatures, and remains in the grease base oil or the grease composition without being polymerized or volatilized. It is also presumed that the ester chain derived from the aromatic carboxylic acid also has high heat resistance and exists stably without thermal deterioration even at high temperatures, and thus remains in the grease base oil or the grease composition without being polymerized or volatilized. Further, it is presumed that the coexistence of the ester chain derived from the cycloalkane monocarboxylic acid and the ester chain derived from the aromatic carboxylic acid suppresses the crystallization between ester molecules even at extremely low temperatures, and thus the grease base oil of the present invention does not solidify and maintains fluidity.

It is also presumed that when the condensation esters contained in the grease base oil of the present invention have a kinematic viscosity at 40° C. of 80 $mm^2$/sec or more and 110 $mm^2$/sec or less, and a kinematic viscosity at 100° C. of 11 $mm^2$/sec or more and 14 $mm^2$/sec or less, the grease base oil is easy to handle, the oil film thickness on the lubricated surface can be secured, and the grease base oil exhibits high lubricity.

MODE FOR CARRYING OUT THE INVENTION

The grease base oil of the present invention contains condensation esters of alcohols (A) and carboxylic acids (B), the alcohols include a polyhydric alcohol represented by General Formula (1):

[Formula 2]

(1)

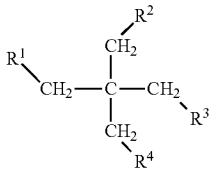

wherein $R^1$ to $R^4$ independently represent a hydrogen atom, a methyl group, or a hydroxyl group, and at least two of $R^1$ to $R^4$ represent a hydroxyl group, and the carboxylic acids include a fatty acid having 5 or more and 9 or less carbon atoms (B-1), a branched fatty acid having 15 or more and 20 or less carbon atoms (B-2), a cycloalkane monocarboxylic acid having 4 or more and 8 or less carbon atoms (B-3), and an aromatic carboxylic acid (B-4).

<Alcohols (A)>

The alcohols (A) include a polyhydric alcohol represented by the General Formula (1).

For $R^1$ to $R^4$ in the General Formula (1), at least two of $R^1$ to $R^4$ are hydroxyl groups, and at least three of $R^1$ to $R^4$ are preferably hydroxyl groups. Examples of the polyhydric alcohol include pentaerythritol, trimethylolpropane, and trimethylolethane, neopentyl glycol. The polyhydric alcohol is preferably pentaerythritol, trimethylolpropane, neopentyl glycol, and more preferably pentaerythritol from the viewpoint of improving the heat resistance and lubricity of the condensation esters.

For the alcohols (A), various monohydric alcohols or polyols can be appropriately used as alcohol components other than the polyhydric alcohol. Monohydric alcohols usually have 1 to 24 carbon atoms, and the carbon chain can be linear or branched, and can be saturated or unsaturated. As polyols, 2 to 10 hydric polyols are usually used.

Examples of the polyols include diol compounds such as ethylene glycol, diethylene glycol, polyethylene glycol, propylene glycol, dipropylene glycol, polypropylene glycol, 1,3-propanediol, 1,2-propanediol, 1,3-butanediol, 1,4-butanediol, 2-methyl-1,2-propanediol, 2-methyl-1,3-propanediol, 1,2-pentanediol, 1,3-pentanediol, 1,4-pentanediol, and 1,5-pentanediol; triol compounds such as 1,2,4-butanetriol, 1,3,5-pentanetriol, and 1,2,6-hexanetriol; multimers of trimethylolalkane such as dipentaerythritol and tripentaerythritol; polyglycerins such as glycerin, diglycerin, triglycerin, and tetraglycerin; and saccharides such as sorbitol, sorbitan, sorbitol glycerin condensate, adonitol, arabitol, xylitol, mannitol, xylose, arabinose, ribose, rhamnose, glucose, fructose, galactose, mannose, sorbose, cellobiose, maltose, isomaltose, trehalose, and sucrose.

<Carboxylic Acids (B)>

The carboxylic acids (B) include a fatty acid having 5 or more and 9 or less carbon atoms (B-1), a branched fatty acid having 15 or more and 20 or less carbon atoms (B-2), a cycloalkane monocarboxylic acid having 4 or more and 8 or less carbon atoms (B-3), and an aromatic carboxylic acid (B-4).

Though the fatty acid having 5 or more and 9 or less carbon atoms (B-1) can have an unsaturated carbon chain or a saturated carbon chain, a saturated carbon chain is preferable from the viewpoint of improving the heat resistance of the condensation esters. The fatty acid (B-1) preferably has 6 or more and 8 or less carbon atoms, and more preferably has 7 carbon atoms from the viewpoint of improving the heat resistance and lubricity of the condensation esters.

Examples of the fatty acid (B-1) include valeric acid, 2-methylvaleric acid, 4-methylvaleric acid, n-hexanoic acid, 2-methylhexanoic acid, 5-methylhexanoic acid, 4,4-dimethylpentanoic acid, n-heptanoic acid, 2-methylheptanoic acid, 2-ethylhexanoic acid, 2,2-dimethylhexanoic acid, n-octanoic acid, 3,5,5-trimethylhexanoic acid, and n-nonanoic acid. From the viewpoint of heat resistance, the fatty acid (B-1) is preferably linear valeric acid, n-hexanoic acid, n-heptanoic acid, n-octanoic acid, or n-nonanoic acid, and more preferably n-heptanoic acid.

Though the branched fatty acid having 15 or more and 20 or less carbon atoms (B-2) can have an unsaturated carbon chain or a saturated carbon chain, a saturated carbon chain is preferable from the viewpoint of improving the heat resistance of the condensation esters. The branched fatty acid (B-2) preferably has 18 or more and 20 or less carbon atoms, and more preferably has 18 carbon atoms from the viewpoint of improving the heat resistance and lubricity of the condensation esters.

Examples of the branched fatty acid (B-2) include 13-methyltetradecanoic acid, 12-methyltetradecanoic acid, 15-methylhexadecanoic acid, 14-methylhexadecanoic acid, 10-methylhexadecanoic acid, 2-hexyldecanoic acid, isopalmitic acid, isostearic acid, isoarachidic acid, and phytanic acid. The branched fatty acid (B-2) is preferably 2-hexyldecanoic acid, isopalmitic acid, isostearic acid, or isoarachidic acid, and more preferably isostearic acid or isopalmitic acid from the viewpoint of improving the heat resistance and lubricity of the condensation esters.

The cycloalkane monocarboxylic acid having 4 or more and 8 or less carbon atoms (B-3) can be substituted with an alkyl chain, and the alkyl chain can be linear or branched.

The cyclo ring of the cycloalkane monocarboxylic acid (B-3) is preferably a 5 to 7-membered ring, more preferably a 6-membered ring from the viewpoint of improving the heat resistance of the condensation esters.

Examples of the cycloalkane monocarboxylic acid (B-3) include cyclopropanecarboxylic acid, cyclobutanecarboxylic acid, cyclopentanecarboxylic acid, cyclohexanecarboxylic acid, cycloheptanecarboxylic acid, and methylcyclohexanecarboxylic acid. The cycloalkane monocarboxylic acid (B-3) is preferably cyclopentanecarboxylic acid, cyclohexanecarboxylic acid, cycloheptanecarboxylic acid, or methylcyclohexanecarboxylic acid, more preferably cyclohexanecarboxylic acid, cycloheptanecarboxylic acid, or methylcyclohexanecarboxylic acid, and further preferably cyclohexanecarboxylic acid from the viewpoint of improving the heat resistance of the condensation esters.

The aromatic carboxylic acid (B-4) can be substituted with an alkyl chain, and the alkyl chain can be linear or branched.

The aromatic ring of the aromatic carboxylic acid (B-4) is preferably a benzene ring or a naphthalene ring, more preferably a benzene ring from the viewpoint of improving the heat resistance of the condensation esters.

Examples of the aromatic carboxylic acid (B-4) include benzoic acid, toluic acid, dimethylbenzoic acid, trimethylbenzoic acid, and naphthoic acid, and benzoic acid is preferable from the viewpoint of improving the heat resistance of the condensation esters.

For the carboxylic acids (B), various carboxylic acids (hereinafter, also referred to as other carboxylic acid compounds) can be appropriately used as the carboxylic acid component other than the components (B-1) to (B-4). Examples of other carboxylic acid compounds include capric acid, lauric acid, myristic acid, palmitic acid, and stearic acid.

Hereinafter, the mixing amount of each component of the present invention will be described.

The alcohols (A) preferably have a percentage of the polyhydric alcohol represented by the General Formula (1) of 80 mol % or more, more preferably have a percentage of the polyhydric alcohol represented by the General Formula (1) of 90 mol % or more, further preferably have a percentage of the polyhydric alcohol represented by the General Formula (1) of 95 mol % or more, still further preferably have a percentage of the polyhydric alcohol represented by the General Formula (1) of 98 mol % or more, and still further preferably have a percentage of the polyhydric alcohol represented by the General Formula (1) of 100 mol %.

The carboxylic acids (B) have a percentage of the fatty acid (B-1) of 30 mol % or more and 50 mol % or less. The carboxylic acids (B) preferably have a percentage of the fatty acid (B-1) of 35 mol % or more from the viewpoint of improving the heat resistance and lowering the kinematic viscosity of the condensation esters, and preferably have a percentage of the fatty acid (B-1) of 40 mol % or less from the viewpoint of increasing the kinematic viscosity of the condensation esters.

The carboxylic acids (B) have a percentage of the branched fatty acid (B-2) of 30 mol % or more and 50 mol % or less. The carboxylic acids (B) preferably have a percentage of the branched fatty acid (B-2) of 35 mol % or more from the viewpoint of improving the heat resistance and increasing the kinematic viscosity of the condensation esters, and preferably have a percentage of the branched fatty acid (B-2) of 40 mol % or less from the viewpoint of lowering the kinematic viscosity of the condensation esters.

The carboxylic acids (B) have a percentage of the cycloalkane monocarboxylic acid (B-3) of 10 mol % or more and 30 mol % or less. The carboxylic acids (B) preferably have a percentage of the cycloalkane monocarboxylic acid (B-3) of 12 mol % or more from the viewpoint of improving the heat resistance of the condensation esters, and preferably have a percentage of the cycloalkane monocarboxylic acid (B-3) of 25 mol % or less from the viewpoint of improving the lubricity of the condensation esters.

The carboxylic acids (B) have a percentage of the aromatic carboxylic acid (B-4) of 1 mol % or more and 15 mol % or less. The carboxylic acids (B) preferably have a percentage of the aromatic carboxylic acid (B-4) of 2 mol % or more from the viewpoint of improving the heat resistance and increasing the kinematic viscosity of the condensation esters, and preferably have a percentage of the aromatic carboxylic acid (B-4) of 13 mol % or less from the viewpoint of lowering the kinematic viscosity of the condensation esters.

The carboxylic acids (B) preferably have a molar ratio of the cycloalkane monocarboxylic acid (B-3) to the aromatic carboxylic acid (B-4) ((B-3)/(B-4)) of 0.5 or more and 20 or less from the viewpoint of improving the low temperature storageability of the condensation esters. The carboxylic acids (B) preferably have a molar ratio of the cycloalkane monocarboxylic acid (B-3) to the aromatic carboxylic acid (B-4) ((B-3)/(B-4)) of 0.8 or more, preferably have a molar ratio of the cycloalkane monocarboxylic acid (B-3) to the aromatic carboxylic acid (B-4) ((B-3)/(B-4)) of 15 or less, and more preferably have a molar ratio of the cycloalkane monocarboxylic acid (B-3) to the aromatic carboxylic acid (B-4) ((B-3)/(B-4)) of 12 or less from the viewpoint of improving the low temperature storageability of the condensation esters.

The carboxylic acids (B) preferably have a total percentage of the fatty acid (B-1), the branched fatty acid (B-2), the cycloalkane monocarboxylic acid (B-3), and the aromatic carboxylic acid (B-4) of 80 mol % or more, more preferably have a total percentage of the fatty acid (B-1), the branched fatty acid (B-2), the cycloalkane monocarboxylic acid (B-3), and the aromatic carboxylic acid (B-4) of 90 mol % or more, further preferably have a total percentage of the fatty acid (B-1), the branched fatty acid (B-2), the cycloalkane monocarboxylic acid (B-3), and the aromatic carboxylic acid (B-4) of 95 mol % or more, still further preferably have a total percentage of the fatty acid (B-1), the branched fatty acid (B-2), the cycloalkane monocarboxylic acid (B-3), and the aromatic carboxylic acid (B-4) of 98 mol % or more, and still further preferably have a total percentage of the fatty acid (B-1), the branched fatty acid (B-2), the cycloalkane monocarboxylic acid (B-3), and the aromatic carboxylic acid (B-4) of 100 mol % from the viewpoint of improving the heat resistance and lubricity of the condensation esters.

The grease base oil preferably has a percentage of the condensation esters of 50% by mass or more and 100% by mass or less, more preferably have a percentage of the condensation esters of 60% by mass or more, further preferably have a percentage of the condensation esters of 70% by mass or more, still further preferably have a percentage of the condensation esters of 80% by mass or more, still further preferably have a percentage of the condensation esters of 90% by mass or more, and still further preferably have a percentage of the condensation esters of 100% by mass from the viewpoint of improving the heat resistance and lubricity of the condensation esters.

<Method for Preparing Condensation Esters>

The condensation esters can be prepared by esterification between the alcohols (A) and the carboxylic acids (B) according to a known method.

In the reaction between the alcohols (A) and the carboxylic acids (B), the equivalent ratio of the two is usually adjusted so that the carboxy group of the carboxylic acid component of the carboxylic acids (B) will be preferably 1.05 to 1.5 equivalents, more preferably 1.1 to 1.3 equivalents relative to one equivalent of the hydroxyl group of the alcohol component of the alcohols (A) from the viewpoint of promoting the esterification. When the ratio of the carboxy group of the carboxylic acid component of the carboxylic acids (B) is increased, the reactivity between the alcohol component and the carboxylic acid component becomes good. However, after the reaction is completed, excess carboxylic acids (B) need to be removed. Examples of the removal method include vacuum distillation, steaming, and adsorption and removal with an adsorbent.

The condensation esters of the present invention preferably have a kinematic viscosity at 40° C. described later of 80 $mm^2/s$ or more, more preferably have a kinematic viscosity at 40° C. described later of 90 $mm^2/s$ or more, and preferably have a kinematic viscosity at 40° C. described later of 110 $mm^2/s$ or less, more preferably have a kinematic viscosity at 40° C. described later of 100 $mm^2/s$ or less from the viewpoint of improving heat resistance. The condensation esters of the present invention preferably have a kinematic viscosity at 100° C. described later of 11 $mm^2/s$ or more, more preferably have a kinematic viscosity at 100° C. described later of 11.5 $mm^2/s$ or more, and preferably have a kinematic viscosity at 100° C. described later of 14 $mm^2/s$ or less, more preferably have a kinematic viscosity at 100° C. described later of 13 $mm^2/s$ or less from the viewpoint of improving lubricity at high temperatures.

The condensation esters of the present invention preferably have a viscosity index described later of 110 or more, more preferably have a viscosity index described later of 115 or more.

<Grease Composition>

The grease composition of the present invention contains the grease base oil.

The grease composition preferably contains a thickener. The thickener is not particularly limited, and examples thereof include a soap thickener, a urea thickener, bentone, and silica gel. Among these, a urea thickener is preferably used from the viewpoint of prevention of damage to mechanical parts and heat resistance. As the urea thickener, a diurea compound is preferable.

Examples of the diurea compound include a compound represented by General Formula (2) below.

$R^1$—NHC(=O)NH—$R^2$—NHC(=O)NH—$R^3$ General Formula (2):

(in Formula (2), $R^2$ represents a divalent aromatic hydrocarbon group having 6 to 15 carbon atoms. $R^1$ and $R^3$ are the same or different groups from each other, and are a cyclohexyl group, an alkyl group having 8 to 22 carbon atoms, or an aromatic hydrocarbon group having 6 to 12 carbon atoms.)

When the thickener is used in the grease composition of the present invention, the mixing ratio of the thickener is preferably 2 to 30% by mass in the composition. When the mixing ratio of the thickener is less than 2% by mass, the effect of addition of the thickener becomes insufficient, and the grease composition does not become sufficiently greasy. For the same reason, the mixing ratio of the thickener is preferably 5% by mass or more, more preferably 10% by mass or more in the composition. When the mixing ratio of the thickener is more than 30% by mass, the grease composition becomes excessively hard, and sufficient lubricity performance cannot be obtained. For the same reason, the mixing ratio of the thickener is preferably 25% by mass or less, more preferably 20% by mass or less in the composition.

If necessary, other additives can be mixed to the grease composition as long as the effects of the present invention are not impaired. Examples of other additives include a detergent, a dispersant, an antioxidant, an oiliness improver, a wear inhibitor, an extreme pressure agent, a rust inhibitor, a corrosion inhibitor, a metal deactivator, a viscosity index improver, a pour-point depressant, a defoamer, an emulsifier, a demulsifier, an antifungal agent, and a solid lubricant.

The total mixing amount of the other additives is usually 10 parts by mass or less relative to 100 parts by mass of the grease composition.

The grease base oil and grease composition of the present invention are excellent in heat resistance and low temperature storageability, thus suitably used even under high temperature and low temperature environments, and are suitable as a grease used for parts that require heat resistance and low-temperature properties, such as a bearing for an air conditioner fan motor, a bearing for an automobile, a bearing for an acoustic instrument, a bearing for a computer, and a bearing for a spindle motor.

EXAMPLES

Hereinafter, though the present invention will be described in more detail with reference to Examples, the present invention is not limited to these Examples.

Example 1

<Preparation of Condensation Esters>

To a 1 liter four-necked flask equipped with a stirrer, a thermometer, a nitrogen blowing tube, and a cooling tube, 189.3 g of n-heptanoic acid (heptanoic acid, manufactured by Tokyo Chemical Industry Co., Ltd.), 413.7 g of isostearic acid (Prisorine 3501, manufactured by Croda Japan KK), 111.8 g of cyclohexanecarboxylic acid (manufactured by Tokyo Chemical Industry Co., Ltd.), and 11.8 g of benzoic acid (manufactured by Tokyo Chemical Industry Co., Ltd.) were added as carboxylic acids (B), and 110 g of pentaerythritol (manufactured by Tokyo Chemical Industry Co., Ltd.) was added as alcohols (A). The amount of the carboxylic acids (B) added was adjusted so that the total carboxy group of the carboxylic acids (B) would be 1.2 equivalents relative to 1 equivalent of the hydroxyl group of pentaerythritol (A).

Then, nitrogen gas was blown into the flask, the temperature was raised to 250° C. with stirring and maintained at 250° C. for 18 hours, and the evaporated water was removed from the flask using a cooling pipe. After completion of the reaction, the excess carboxylic acid components were distilled off under a reduced pressure of 0.13 kPa, steaming was performed for 1 hour under reduced pressure of 0.13 kPa, the carboxylic acid components remaining on the adsorbent (trade name: KYOWAAD 500SH, manufactured by Kyowa Chemical Industry Co., Ltd.) were adsorbed, and then filtration was performed to obtain the condensation esters of Example 1. The obtained condensation esters were evaluated as follows. The evaluation results are shown in Table 1.

<Evaluation of Heat Resistance>

For the evaluation of heat resistance, the thermal response of the condensation esters was measured under the condition of raising the temperature from 35° C. to 550° C. at 10° C./min and holding the temperature at 550° C. for 10 minutes under an atmosphere of 250 mL/min of nitrogen and air using a simultaneous thermogravimetric analyzer (trade name: TG/DTA6200, manufactured by Seiko Instruments Inc.), and the residual percentage (% by mass) was calculated by the following formula. The larger the residual percentage value, the better the heat resistance. Formula: Residual percentage (% by mass)=mass at 370° C.=mass at 35° C.×100

<Evaluation of Kinematic Viscosity>

For evaluation of kinematic viscosity, 40° C. kinematic viscosity and 100° C. kinematic viscosity ($mm^2/s$) were measured with a Stabinger kinematic viscometer (trade name: SVM3000, manufactured by Anton Paar GmbH) that meets the accuracy required by ASTM D7042. The viscosity indexes are results obtained at the same time as the viscosity measurement.

<Low Temperature Storageability>

Condensation esters (30 mL) were added to a LABORAN Screw Tube Bottle (manufactured by AS ONE Corporation, No. 7, 50 mL) and stored at −40° C. using a cryostat (PU-1KP, manufactured by ESPEC CORP.). After a certain period of time, the presence or absence of fluidity (solidification) of the condensation esters when the screw tube bottle was tilted to a horizontal position was visually observed.

<Preparation of Grease Composition>

In the condensation esters obtained above, 1 mol of diphenylmethane diisocyanate (MDI) was reacted with 2 mol of amine (cyclohexylamine (CHA) and stearylamine in a molar ratio of 5:1) and the resulting product was further diluted with the condensation esters obtained above to adjust the worked penetration to 280 (JIS K2220), thereby a base grease was prepared. The following additives were added to this base grease to prepare a grease composition, and the following evaluation was performed (the percentage of the thickener in the grease composition was 13% by mass).

(Additive)

Antioxidant: 2.0% by mass of amine antioxidant (alkyldiphenylamine) and 1.0% by mass of phenol antioxidant (3-(4'-hydroxy-3',5'-di-tert-butylphenyl)propionate-n-octadecyl)

<Evaluation of Lubricity at Low Temperature>

This test was performed using each of the grease compositions above in accordance with the low temperature torque test specified in JIS K2220 18. It should be noted that the lower the starting torque, the better the lubricity at a low temperature, and also the lower the rotational torque, the better the lubricity at a low temperature.

(Condition)

Bearing type: 6204

Test temperature: −40° C.

Rotation speed: 1 rpm

Measurement item: starting torque (maximum torque at the start of measurement), rotational torque (average torque in the last 15 seconds of 10 minutes of rotation)

<Evaluation of Lubricity at High Temperature>

This test was an inner ring rotation test that evaluates the bearing lubrication life at high temperatures in accordance with ASTM D3336 using each of the grease compositions above. The lubrication life was defined as the time until the motor generates an overcurrent or the bearing temperature rises by +15° C. when a rolling bearing is operated under the following conditions. The longer the operation time, the better the lubricity at high temperatures.

(Condition)

Bearing type: 6204 metal seal

Test temperature: 180° C.

Rotation speed: 10,000 rpm

Grease amount: 1.8 g

Test load: axial load of 66.7 N, radial load of 66.7 N

Examples 2 to 3, Comparative Examples 1 to 3

Condensation esters and grease compositions were prepared in the same manner as in Example 1 except that the type of the raw materials and the mixing amounts thereof were changed as shown in Table 1, and the same evaluations were performed. The evaluation results are shown in Table 1.

TABLE 1

| | Charged amount | | | | | | | | | | | | | | | | | |
|---|---|---|---|---|---|---|---|---|---|---|---|---|---|---|---|---|---|---|
| | | Raw material B | | | | | | | | | | | | | | | | |
| | | Mol % | | | | % by mass | | | | Evaluation | | | | | | | | |
| | Raw material A | n-Heptanoic acid | Isostearic acid | Cyclo-hexane-carboxylic acid | Benzoic acid | n-Heptanoic acid | Isostearic acid | Cyclo-hexane-carboxylic acid | Benzoic acid | Residual rate (% by mass) | 40° C. Kinematic viscosity ($mm^2/s$) | 100° C. Kinematic viscosity ($mm^2/s$) | Viscosity index | Storage test | −40° C. Low temperature torque (mN · m) Starting | −40° C. Low temperature torque (mN · m) Rotational | Bearing lubrication life (h) |
| Example 1 | Pentaerythritol | 37.50 | 37.50 | 22.50 | 2.50 | 26.05 | 56.93 | 15.39 | 1.63 | 87.40 | 92.52 | 12.08 | 123.0 | Unsolidified after 1 week | 450 | 230 | 912 |
| Example 2 | Pentaerythritol | 37.50 | 37.50 | 18.75 | 6.25 | 26.08 | 57.00 | 12.84 | 4.08 | 79.50 | 99.48 | 12.58 | 120.6 | Unsolidified after 1 week | — | — | — |
| Example 3 | Pentaerythritol | 37.50 | 37.50 | 12.50 | 12.50 | 26.14 | 57.11 | 8.58 | 8.17 | 81.50 | 98.70 | 12.31 | 117.3 | Unsolidified after 1 week | — | — | — |
| Comparative Example 1 | Pentaerythritol | 37.50 | 37.50 | — | 25.00 | 26.24 | 57.35 | — | 16.41 | 64.78 | 100.56 | 12.00 | 109.5 | Solidified in 1 hour | 860 | 630 | 255 |
| Comparative Example 2 | Pentaerythritol | 62.50 | 12.50 | — | 25.00 | 55.18 | 24.12 | — | 20.70 | 38.33 | 60.75 | 8.27 | 105.0 | Solidified in 1 hour | 530 | 290 | — |
| Comparative Example 3 | Pentaerythritol | 37.50 | 37.50 | 25.00 | — | 26.03 | 56.88 | 17.09 | — | 77.20 | 90.32 | 12.03 | 125.8 | Solidified in 1 hour | 510 | 230 | 114 |

The invention claimed is:

1. A grease base oil, containing:

condensation esters of alcohols (A) and carboxylic acids (B), wherein the alcohols (A) include a polyhydric alcohol represented by General Formula (1):

[Formula 1]

(1)

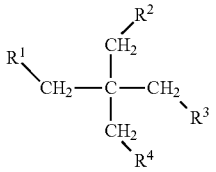

wherein $R^1$ to $R^4$ independently represent a hydrogen atom, a methyl group, or a hydroxyl group, and at least two of $R^1$ to $R^4$ represent a hydroxyl group, the carboxylic acids (B) include a fatty acid having 5 or more and 9 or less carbon atoms (B-1), a branched fatty acid having 15 or more and 20 or less carbon atoms (B-2), a cycloalkane monocarboxylic acid having 4 or more and 8 or less carbon atoms (B-3), and an aromatic carboxylic acid (B-4), and the carboxylic acids (B) have a percentage of the fatty acid (B-1) of 30 mol % or more and 50 mol % or less, a percentage of the branched fatty acid (B-2) of 30 mol % or more and 50 mol % or less, a percentage of the cycloalkane monocarboxylic acid (B-3) of 10 mol % or more and 30 mol % or less, and a percentage of the aromatic carboxylic acid (B-4) of 1 mol % or more and 15 mol % or less.

2. The grease base oil according to claim 1, wherein the condensation esters have a kinematic viscosity at 40° C. of 80 $mm^2$/sec or more and 110 $mm^2$/sec or less, and a kinematic viscosity at 100° C. of 11 $mm^2$/sec or more and 14 $mm^2$/sec or less.

3. The grease base oil according to claim 1, having a molar ratio of the cycloalkane monocarboxylic acid (B-3) to the aromatic carboxylic acid (B-4) ((B-3)/(B-4)) of 0.5 or more and 20 or less.

4. The grease base oil according to claim 1, wherein the alcohols (A) are pentaerythritol, the fatty acid having 5 or more and 9 or less carbon atoms (B-1) is n-heptanoic acid, the branched fatty acid having 15 or more and 20 or less carbon atoms (B-2) is isostearic acid, the cycloalkane monocarboxylic acid having 4 or more and 8 or less carbon atoms (B-3) is cyclohexanecarboxylic acid, and the aromatic carboxylic acid (B-4) is benzoic acid.

5. The grease base oil according to claim 1, having a percentage of the condensation esters of 50% by mass or more and 100% by mass or less.

6. A grease composition, containing:

the grease base oil according to claim 1.

* * * * *